US007874727B2

(12) United States Patent
Forster et al.

(10) Patent No.: US 7,874,727 B2
(45) Date of Patent: Jan. 25, 2011

(54) CONTROL METHOD FOR GUIDED MOVEMENT OF AN X-RAY EXAMINATION SYSTEM

(75) Inventors: Gerhard Forster, Schwarzenbruck (DE); Jens Hamann, Fürth (DE); Uwe Ladra, Erlangen (DE); Claus-Günter Schliermann, Kemnath (DE); Elmar Schäfers, Fürth (DE)

(73) Assignee: Siemens Aktiengesellschaft, Munich (DE)

( * ) Notice: Subject to any disclaimer, the term of this patent is extended or adjusted under 35 U.S.C. 154(b) by 95 days.

(21) Appl. No.: 11/918,691

(22) PCT Filed: Apr. 18, 2006

(86) PCT No.: PCT/EP2006/061636

§ 371 (c)(1),
(2), (4) Date: Jun. 12, 2009

(87) PCT Pub. No.: WO2006/111525

PCT Pub. Date: Oct. 26, 2006

(65) Prior Publication Data

US 2009/0310752 A1 Dec. 17, 2009

(30) Foreign Application Priority Data

Apr. 20, 2005 (DE) ..... 10 2005 018 326

(51) Int. Cl.
*H05G 1/02* (2006.01)

(52) U.S. Cl. ..... 378/196; 378/197

(58) Field of Classification Search ..... 378/4, 378/15, 19, 62, 65, 196, 197
See application file for complete search history.

(56) References Cited

U.S. PATENT DOCUMENTS 4,798,006 A 1/1989 Barnaby (Continued)

FOREIGN PATENT DOCUMENTS

DE 102 00 680 3/2004

(Continued)

OTHER PUBLICATIONS

International Search Report dated Aug. 22, 2006.

(Continued)

*Primary Examiner*—Irakli Kiknadze
(74) *Attorney, Agent, or Firm*—Brinks, Hofer, Gilson & Lione

(57) ABSTRACT

According to the invention, an X-ray examination may be simply and rapidly carried out and hence produce a sharp X-ray image with an X-ray source and/or X-ray receiver an X-ray examination system which may be displaced relative to the mounting position thereof by means of an actuator, despite a system construction which may be caused to oscillate at a resonant frequency dependent on the corresponding mounting position, about the mounting position, whereby according to the inventive method, at least one parameter relevant to the resonant frequency, dependent on the corresponding mounting position, is determined, a set guided movement, counteracting the cause of oscillation in order to achieve a movement condition for the X-ray source or X-ray receiver necessary for the X-ray examination, is determined depending on the at least one corresponding parameter and the guided movement of the X-ray source and/or X-ray receiver controlled using the actuator according to the set guided movement.

19 Claims, 4 Drawing Sheets

U.S. PATENT DOCUMENTS

| | | | |
|---|---|---|---|
| 4,872,190 | A | 10/1989 | Stojkov et al. |
| 6,580,245 | B2 | 6/2003 | Zander et al. |
| 6,825,633 | B2 | 11/2004 | Hamann et al. |

FOREIGN PATENT DOCUMENTS

| | | |
|---|---|---|
| JP | 2003 190140 | 7/2003 |

OTHER PUBLICATIONS

Written Opinion dated Aug. 2006.

Meckl et al., "Minimizing Residual Vibration for Point-to-Point Motion," *Journal of Vibration and Accoustics*, American Society of Mechanical Engineers, vol. 107, No. 4, Oct. 1985, pp. 378-328.

CONTROL METHOD FOR GUIDED MOVEMENT OF AN X-RAY EXAMINATION SYSTEM

The present patent document is a 35 U.S.C. §371 nationalization of PCT Application Serial Number PCT/EP2006/061636 filed Apr. 18, 2006, designating the United States, which is hereby incorporated by reference, which claims the benefit pursuant to 35 U.S.C. §119(e) of German Patent Application No. 10 2005 018 326.3, filed Apr. 20, 2006, which is hereby incorporated by reference.

BACKGROUND

The present embodiments relate to guided movement of an X-ray emitter and/or X-ray receiver of an X-ray examination system.

An X-ray examination system may be used to perform an X-ray examination. The X-ray examination system may include an X-ray emitter and/or X-ray receiver. The X-ray examination system is movable into various mounting positions. The X-ray examination system is put in a motion state that is intended for the particular X-ray examination and that typically, depending on the X-ray examination, corresponds to a persistence in or a uniform motion in an intended mounting position. The X-ray emitter and/or X-ray receiver can move at a resonant frequency that is dependent on the respective mounting position relative to the X-ray examination system, due to vibration that leads to blurriness in an X-ray image prepared during the X-ray examination. To avoid this blurriness, calming times for decaying of the vibration are provided between when the motion state, which is intended for X-ray examination, is reached and when the X-ray image is created.

SUMMARY

The present embodiments may obviate one or more of the drawbacks of limitations inherent in the related art. For example, in one embodiment, an X-ray examination system, despite a system construction that is capable of vibration, enables an X-ray examination to be performed quickly with the creation of a sharp X-ray image.

As a function of at least one previously detected variable that is dependent on a respective mounting position, a set-point guided movement for reaching a motion state, intended for an X-ray examination, of an X-ray emitter and/or X-ray receiver is ascertained. The set-point guided movement is ascertained such that in an ensuing control of the guided movement of the X-ray emitter and/or X-ray receiver by a drive device in accordance with the set-point guided movement, an excitation of vibration of the X-ray emitter and/or X-ray receiver at a resonant frequency is prevented in advance. A calming time for decay of the vibration can be omitted. Blurriness in an X-ray image that can be created in the X-ray examination can be prevented.

The set-point guided movement includes control of the course of motion over time of the X-ray emitter and/or X-ray receiver. A selection of the at least one variable on which the ascertainment of the set-point guided movement is based is made such that the at least one variable permits a conclusion to be drawn about the particular resonant frequency to be expected. This selection depends on the particular use of the control method.

The at least one variable can be detected precisely in each case by using the at least one variable in the form of at least one measured variable that is detectable by a measurement.

The at least one measured variable may be measured once and before the guided movement and/or in addition repeatedly during the guided movement.

The at least one variable can be detected by using the at least one variable in the form of at least one actuating variable that is detectable from a motion control of the X-ray emitter and/or X-ray receiver. The at least one actuating variable may be ascertained from a motion control, performed before the guided movement, of the X-ray emitter and/or X-ray receiver that is movable by the drive device, taking an outset position for the motion control into account. The outset position corresponds, for example, to an equipment-specific mounting position to which the X-ray emitter and/or X-ray receiver is regularly retracted, for example, after each X-ray examination.

In one embodiment, an X-ray examination device has an X-ray emitter and/or X-ray receiver. The X-ray examination device, which is mounted in a way that is vulnerable to vibration, avoids vibration.

In one embodiment, an X-ray examination system includes a vertically oriented telescoping tripod. The tripod is displaceable in a horizontal plane. A telescoping end of the tripod can be vertically extended to various extended lengths as a mounting position for the X-ray emitter and/or X-ray receiver. The X-ray examination system is provided in which the ascertainment of the set-point guided movement of a horizontal displacement position of the telescoping tripod is based on the respective extension lengths as a variable. Since the telescoping tripod mounts the X-ray emitter and/or X-ray receiver in an exposed position, this mechanical system is especially vulnerable to vibration, so that the control method can be employed. Applying the control method to such an X-ray examination system is simple, given the geometric construction of this X-ray examination system. Only one variable may definitively determine the respective resonant frequency.

The X-ray emitter and/or X-ray receiver is tiltable in its orientation to various tilt angles. The resonant frequency may be determined by taking into account both the extension length and the respective tilt angle as a further variable in ascertaining the set-point guided movement.

In a further embodiment, an X-ray examination system includes an above-table or below-table fluoroscope with an examination table that is tiltable at different tilt angles. The X-ray examination system includes one mounting position each below and above the examination table. Each mounting position is longitudinally displaceable, for the X-ray emitter and the X-ray receiver. The ascertainment of the set-point guided movement of the mounting positions is based on the respective tilt angle as a variable.

The resonant frequency in an above-table or below-table fluoroscope, whose mounting position can be displaced in height to different spacings relative to the examination table, can be determined by taking into account the tilt angle and the respective spacing as a further variable in ascertaining the set-point guided movement. The mounting position is located above the examination table.

In one embodiment, an X-ray examination system includes a C-arm tripod with a C-arm mounting arm that is rotatable by various orbital and/or angulation angles for mounting the X-ray emitter and the X-ray receiver. The ascertainment of the set-point guided movement of the C-arm mounting arm is based on the respective orbital and/or angulation angle as variables. Since the C-arm mounting arm is mounted in an exposed way and itself has a longitudinally extended shape, it represents a mechanical structure that is vulnerable to vibration. A control method may be employed with this structure.

In order to avoid taking into account variables that change during the guided movement when the set-point guided movement is being ascertained for a rotation of the C-arm mounting arm, it is typically sufficient, given an exclusively orbital motion, to take only the angulation angle into account, and in exclusively angulation motion to take solely the orbital angle into account.

In an X-ray examination system having a C-arm tripod that can be displaced horizontally to various displacement widths, ascertaining the set-point guided movement is referred to a horizontal displacement of the C-arm tripod. For example, a guided movement in which the orbital and the angulation angle remain constant, while only the displacement width changes, so that the resonant frequency determined by the two angles does not change during the displacement.

In an X-ray examination system with a C-arm tripod that can be displaced horizontally to various displacement widths, in order to enable horizontal displacement of the C-arm tripod and avoid inducing vibration, the set-point guided movement is ascertained with regard to the horizontal displacement of the C-arm tripod with the X-ray emitter and the X-ray receiver. The respective orbital and angulation angle, which are variables that are definitive for the resonant frequency, may remain constant.

Several methods for X-ray examination can apply the control method with the aforementioned X-ray examination system.

In one embodiment, an X-ray examination with a prior automatic positioning of the X-ray emitter and/or X-ray receiver to a constant mounting position may be used for the X-ray examination, and with a motion state in the form of a persistence, lasting for the duration of the X-ray examination, in the intended mounting position. For this motion state, the set-point guided movement for reaching this motion state can be ascertained with little effort and expense.

In one embodiment, a motion state in the form of persistence (remaining) in the mounting position and for motion states in the form of a movement of the mounting position can be used. In one embodiment, for example, an X-ray examination may be done using a planigraphy procedure, with a rectilinear motion state at a constant speed. The avoidance of blurriness in planigraphy increases the image quality. The embodiment is effective for improving the image quality.

In one embodiment, an angiography procedure is used for an X-ray examination. The angiography procedure includes an incremental displacement of the X-ray emitter and/or X-ray receiver to various intended mounting positions. A motion state in the form of a temporary persistence in one of the mounting positions enables fast incremental displacement to the respective mounting position without inducing vibration on the part of the X-ray emitter and/or X-ray receiver.

In one embodiment, rotational angiography is used for an X-ray examination. The rotational angiography includes a circular motion state with a constant rotary speed. Using the control method with the rotational angiography creates a vibration-free rotary motion. The vibration-free rotary motion allows a sharp, interference-free, three-dimensional X-ray image to be created at a high rotary speed.

In one embodiment, the resonant frequency is determined based on the respective at least one variable. Then, the set-point guided movement is ascertained as a function of this resonant frequency. The set-point guided movement counteracts vibration of the X-ray emitter and/or X-ray receiver at the resonant frequency in the intended motion state. The association of the resonant frequency with the respective at least one variable, based on a series of tests done prior to equipment operation, is stored in memory and is called up (retrieved) to determine the applicable resonant frequency in operation. In the series of tests, the X-ray emitter and/or X-ray receiver is moved to various mounting positions, being excited to vibration by an impact or deflection excitation, and a respective vibration frequency that corresponds to the respective resonant frequency is measured.

For reduced-vibration guided movement, some methods, both linear and nonlinear, are widely known in conjunction with industrial processing machines.

In one embodiment, a trial guided movement for attaining the intended motion state is ascertained without avoiding the vibration. Using this trial guided movement and a filter that prevents the vibration, the set-point guided movement is ascertained as a function of the at least one respective variable. This linear method permits easy use of the control method.

The set-point guided movement is ascertained using the linear method known as input shaping.

German Patent Disclosure DE 102 00 680 B4 discloses a jolt-equivalent filter. The set-point guided movement is ascertained using a nonlinear jolt-limitation method, in a manner that is robust with regard to external interfering factors.

DETAILED DESCRIPTION

Figure 1:
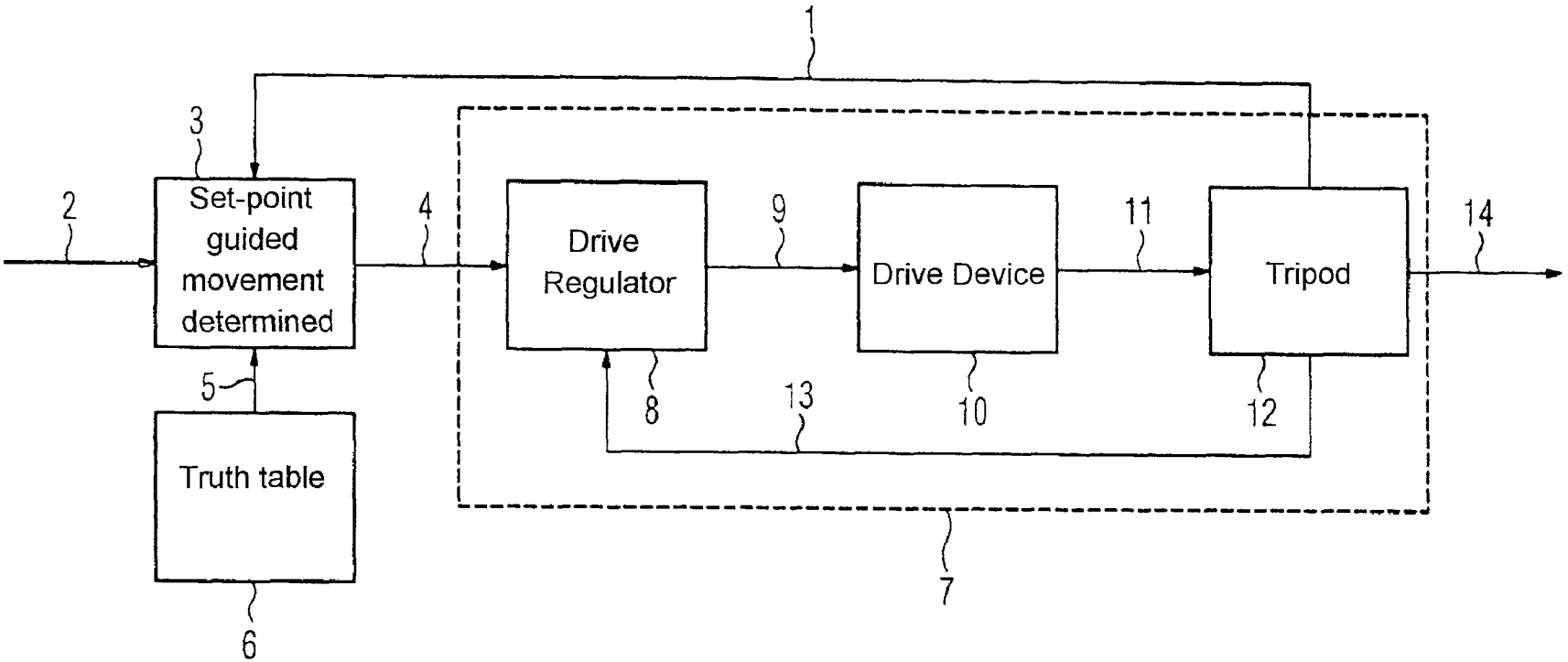
FIG. 1 illustrates a flow chart for guided movement of an X-ray emitter and/or X-ray receiver with a closed-loop control circuit.

FIG. 1 shows a flow chart of a control method for guided movement of an X-ray emitter and/or X-ray receiver of an X-ray examination system. The X-ray examination system is movable in terms of its mounting position with the aid of a drive device 10. A closed-loop control circuit 7 may control the drive device 10. The X-ray emitter and/or X-ray receiver are placed into actual motion state 14. The actual motion state 14 corresponds to an intended motion state 2. Vibration at a resonant frequency 5 that is dependent on the respective mounting position is avoided.

The flow chart will be described below in terms of three acts in the control method in this exemplary embodiment.

In a first act, at least one measured variable 1, dependent on the respective mounting position of the X-ray emitter and/or X-ray receiver and relevant to the resonant frequency, is detected.

In a second act, the ascertainment 3 of a set-point guided movement 4 for attaining the intended motion state 2 is accomplished with the aid of an input shaping method, as a function of the resonant frequency 5 determined by the at least one measured variable 1 and a truth table 6 prepared with the aid of a series of tests done before operation begins. The at least one measured variable 1 is assigned a respective resonant frequency 5. By the input shaping method, first a trial guided movement is ascertained, which is not yet optimized with regard to avoidance of vibration. The trial guided movement is then broken down by a pulse train into a plurality of segments, so that after the guided movement has taken place, there is no vibration in the actual motion state 14.

In a third act, the guided movement of the drive device 10 is controlled with the aid of a closed-loop control circuit 7 in accordance with the set-point guided movement 4. The closed-loop control circuit 7 includes the following: a drive regulator 8, a drive device 10, and a tripod 12. The set-point guided movement 4 is forwarded to the drive regulator 8, which regulates a drive current 9. The drive device 10 moves the X-ray emitter and/or X-ray receiver, regulated by the drive current 9, and generates a movement force 11. The tripod 12 mounts the X-ray emitter and/or X-ray receiver. The tripod 12 is moved by the movement force 11 and has sensors. The sensors detect the at least one measured variable 1 and the controlled variables 13 of the closed-loop control circuit 7. The controlled variables 13 are forwarded to the drive regulator 8 for closing the closed-loop control circuit 7.

The set-point guided movement 4 is adapted exactly to the respective resonant frequency 5 by taking the damping action, which shifts the resonant frequency, of this closed-loop control circuit 7 into account.

The ascertainment 3 of the set-point guided movement 4 may take the at least one measured variable 1 and optionally further equipment-specific variables into account. The further equipment-specific variables may include a predetermined maximum acceleration and/or maximum speed.

The at least one measured variable may be re-detected continuously during the guided movement. The set-point guided movement 4 may be adapted accordingly, so that a rapid response is possible to an unforeseen event, such as an error in controlling the drive device 10.

The control method may include taking a plurality of resonant frequencies into account on the same basic principle.

Figure 2:
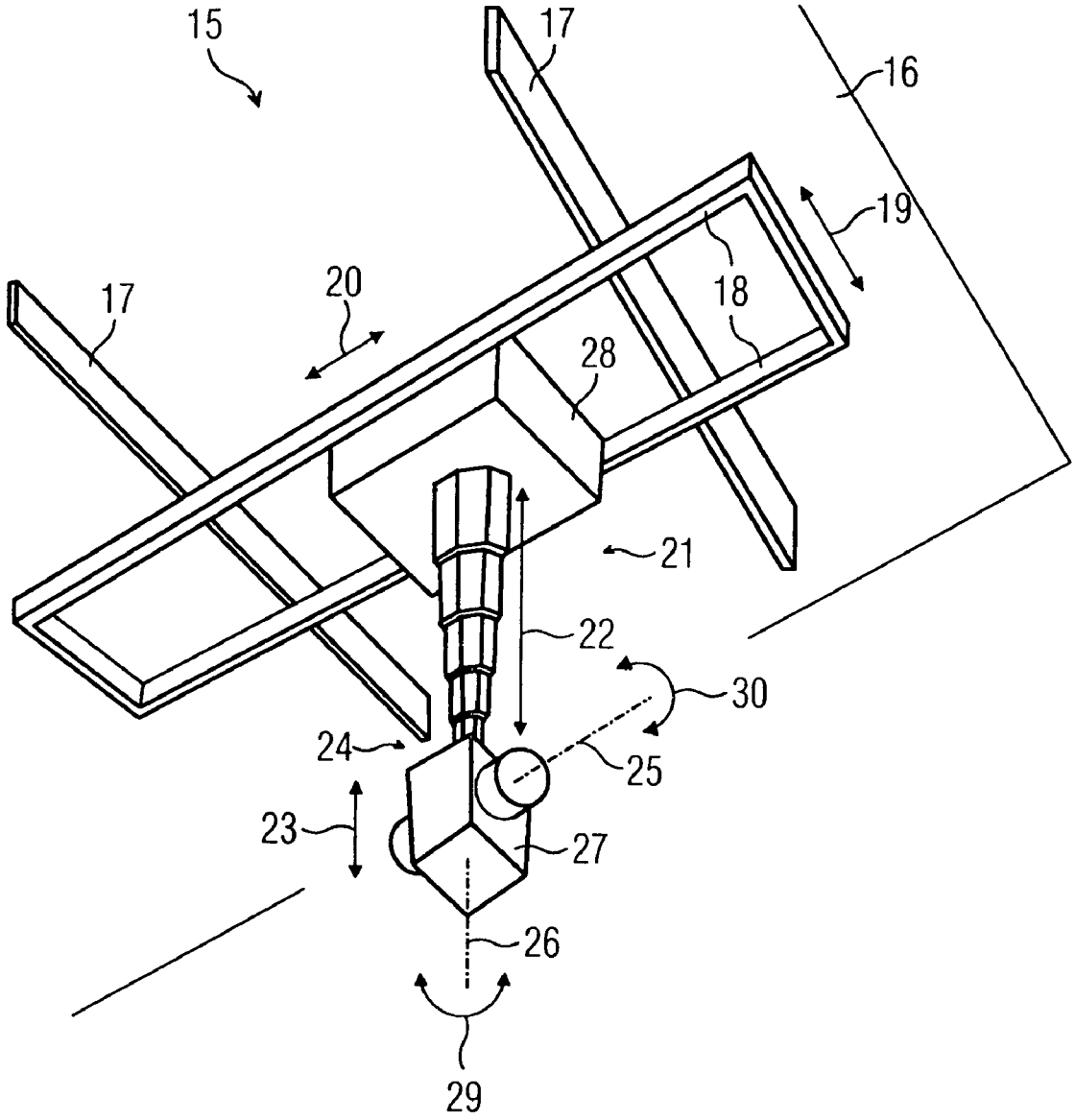
FIG. 2 illustrates one embodiment of an X-ray examination system.

FIG. 2, shows one embodiment of an X-ray examination system 15. The X-ray examination system 15 includes a telescoping tripod 21. The tripod 21 is horizontally displaceable in two directions 19, 20 in space on a ceiling 16 of a room by a rail system 17, 18. The tripod 21 has a telescoping end 24, which can be extended vertically to various extension lengths 22 in a third direction 23 in space, acting as a mounting position for an X-ray emitter 27 that can be rotated or tilted about two axes 25, 26. An X-ray receiver and other components belonging to the first X-ray examination system 15, such as an examination table, are not shown here.

A first pair of rails 17 of the rail system are secured to the ceiling 16 of the room. A second pair of rails 18, which are perpendicular to the first pair of rails 17, are secured to the first pair and are displaceable relative to the first pair 17 in a first direction 19 in space. A base 28 of the telescoping tripod 21 is secured to the second pair of rails 18 and is displaceable in a second direction 20 in space perpendicular to the first direction 19 in space relative to the second pair of rails 18. The mounting position of the X-ray emitter 27 is varied f by a displacement of the telescoping tripod 21 and by an extension of the telescoping end 24, in all three directions 18, 19, 23. The respective extension length 24 definitively determines the resonant frequency.

An X-ray beam, which can be projected by the X-ray emitter 27, may be adjusted in its beam direction. The X-ray beam may be adjusted by a rotation of the X-ray emitter 27 about a vertical axis 26 by a rotary angle 29 and tilting the X-ray emitter 27 about a horizontal axis 25 about a tilt angle 30. Besides the respective extension length 22, only the tilt angle 30, as a standard for the respective tilting of the X-ray emitter 27, jointly determines the resonant frequency.

In one embodiment of the control method, the extension length 22 is detected as a measured variable, for example, with the aid of a cable potentiometer integrated with the telescoping tripod 21. Optionally, the tilt angle 30 is also detected as a further measured variable. A set-point guided movement is ascertained as a function of the at least one measured variable. A respective drive device for moving the X-ray emitter 27 in the three directions 19, 20, 22 in space is controlled in accordance with the set-point guided movement. The extension length 22 may be manually varied, so that only the displacement of the X-ray emitter 27 in the horizontal directions 19, 20 in space is controlled. Taking a change in the resonant frequency definitively determined by the extension length 22 into account, which is otherwise necessary, can be dispensed with in ascertaining the set-point guided movement. The rotation of the X-ray emitter 27 about the vertical axis 26 and the tilting of the X-ray emitter 27 about the horizontal axis 25 may be controlled.

A two-dimensionally projected X-ray image may be created with the first X-ray examination system 15. The X-ray emitter 27 is positioned at the mounting position intended for the X-ray examination in accordance with the set-point guided movement ascertained with the aid of the control method. The X-ray emitter 27 remains in this mounting position for the duration of the X-ray examination. An otherwise necessary decay time for the vibration of the X-ray emitter 27 between when the X-ray emitter 27 is positioned at this mounting position and the X-ray image is created is thus dispensed with.

The X-ray emitter 27 and an additional X-ray receiver can be located on separate telescoping tripods. The telescoping tripods being horizontally displaceably independently of one another. In accordance with FIG. 1, a planigraphy procedure may be performed on a patient lying between the X-ray emitter 27 and the X-ray receiver, for example, on an examination table. In the planigraphy procedure, the X-ray emitter 27 and the X-ray receiver move contrary to one another on respective different levels of motion, in such a way that only one slice through of the patient's body, oriented with the planes of motion and located between them, is sharply reproduced on an X-ray image. For the image quality, what is definitive is a uniform motion without vibration superimposed on it. Before the X-ray image is created, the X-ray emitter 27 and the X-ray receiver are put in a motion state corresponding to the set-point guided movement ascertained by the control method. The X-ray emitter 27 on one side of the patient and the X-ray receiver on an opposite side of the patient move, in respective opposite directions, at a constant speed along the patient. Once again, the decay time before the X-ray image is made is eliminated. During the creation of the X-ray image, the X-ray beam is expediently jointly pivoted in such a way that it temporarily strikes the X-ray receiver. This is effected by suitable rotation or tilting of the X-ray emitter or suitable incorporation of the X-ray beam.

Figure 3:
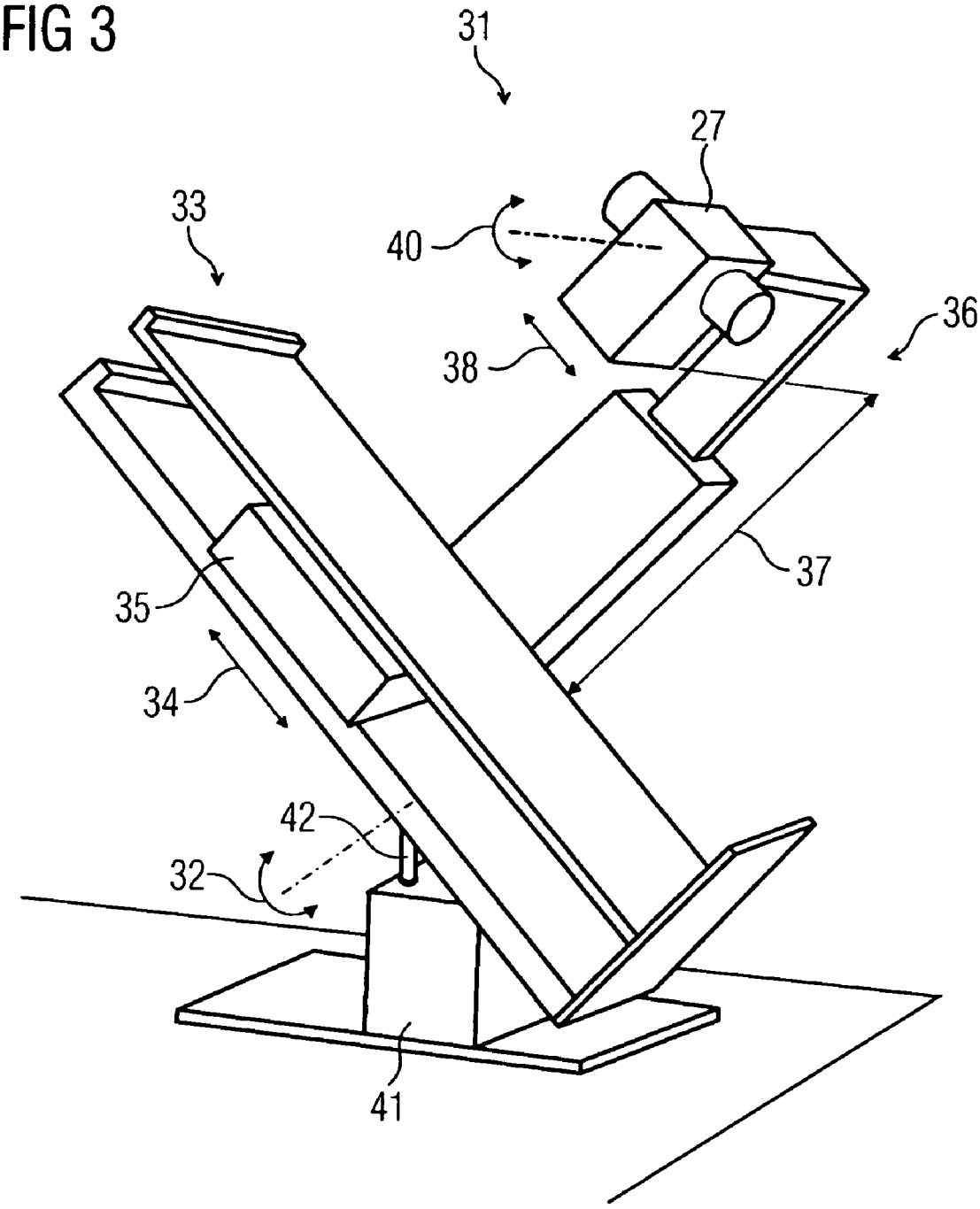
FIG. 3, illustrates one embodiment of an X-ray examination system.

FIG. 3 shows one embodiment of the X-ray examination system 15. The X-ray examination system is in the form of an above-table fluoroscope system 31, which has an examination table 33 that can be tilted by different tilt angles 32, an X-ray receiver 35, and an X-ray emitter 27. The X-ray receiver 35 is integrated into the examination table. The X-ray receiver 35 is longitudinally displaceable in a first direction 34 in a lower mounting position. An X-ray emitter 27 is mounted with an extensible tripod 36. The X-ray emitter 27 is displaceable in height at various spacings 37 from the examination table 33 and longitudinally displaceable in a second direction 38 parallel to the first direction 34 and pivotable about an angle 40, in an upper mounting position.

The examination table 33 is mounted on a floor-mounted pedestal 41. The examination table 33 is tilted by the floor-mounted pedestal 41 via an electrical drive mechanism 42.

The floor-mounted pedestal 41 varies the tilt angle 32 that definitively determines the respective resonant frequency. For the longitudinal displacement of the X-ray receiver 35 and the X-ray emitter 27 along a longitudinal axis of the examination table 55 and for the heightwise displacement of the X-ray emitter 27, a further drive device each is provided. Besides the respective tilt angle 32, only the spacing 37 jointly determines the respective resonant frequency.

In an embodiment with the above-table fluoroscope 31, the tilt angle 32 is detected as the measured variable, for example, with the aid of a sensor integrated with the floor-mounted pedestal 41. Optionally, the spacing 37 is detected as a further measured variable. A set-point guided movement of the X-ray emitter 27 and X-ray receiver 35 is ascertained as a function of the at least one measured variable. The drive devices for moving the X-ray emitter in the direction 34 and for moving the X-ray receiver 35 in the direction 34 are controlled in accordance with the set-point guided movement. Since the tilt angle 32 and the spacing 37 may remain constant during the guided movement, there is no need to take a change in these measured variables into account in ascertaining the set-point guided movement.

The above-table fluoroscope system 31 may perform the X-ray examination with the prior automatic positioning to the intended mounting position and to perform the X-ray examination by planigraphy in an analogous way. With the above-table fluoroscope system 31, it is possible to perform angiography with an incremental displacement of the X-ray emitter 27 and X-ray receiver 35 to various intended mounting positions. The angiography procedure may be used to examine the lower extremities of the patient. The incremental displacement may be done in a first pass counter to a blood flow direction in the vessels to be examined in the lower extremities, and after an injection of a contrast agent, in a second pass in the blood flow direction. In the two passes, the X-ray emitter 27 and the X-ray receiver 35, for creating congruent X-ray images, are positioned as precisely as possible at the intended mounting positions by parallel displacement in the respective directions 38 and 34, so that a differential image from a first X-ray image of the first pass and a second X-ray image of the second pass, which is congruent with the first X-ray image, shows the vessels. This method, which is based on finding a difference, is digital subtraction angiography. Since the speed of the incremental displacement in the second pass is oriented to the flow speed of the contrast agent in the vessels, mounting positions must be reached especially quickly in each case, and hence the risk of excitation of vibration, especially of the X-ray emitter 27 mounted in an exposed position, is especially high.

In a below-table fluoroscope system, the mounting positions of the X-ray emitter 27 and X-ray receiver 35 are transposed compared to the above-table fluoroscope system 31.

Figure 4:
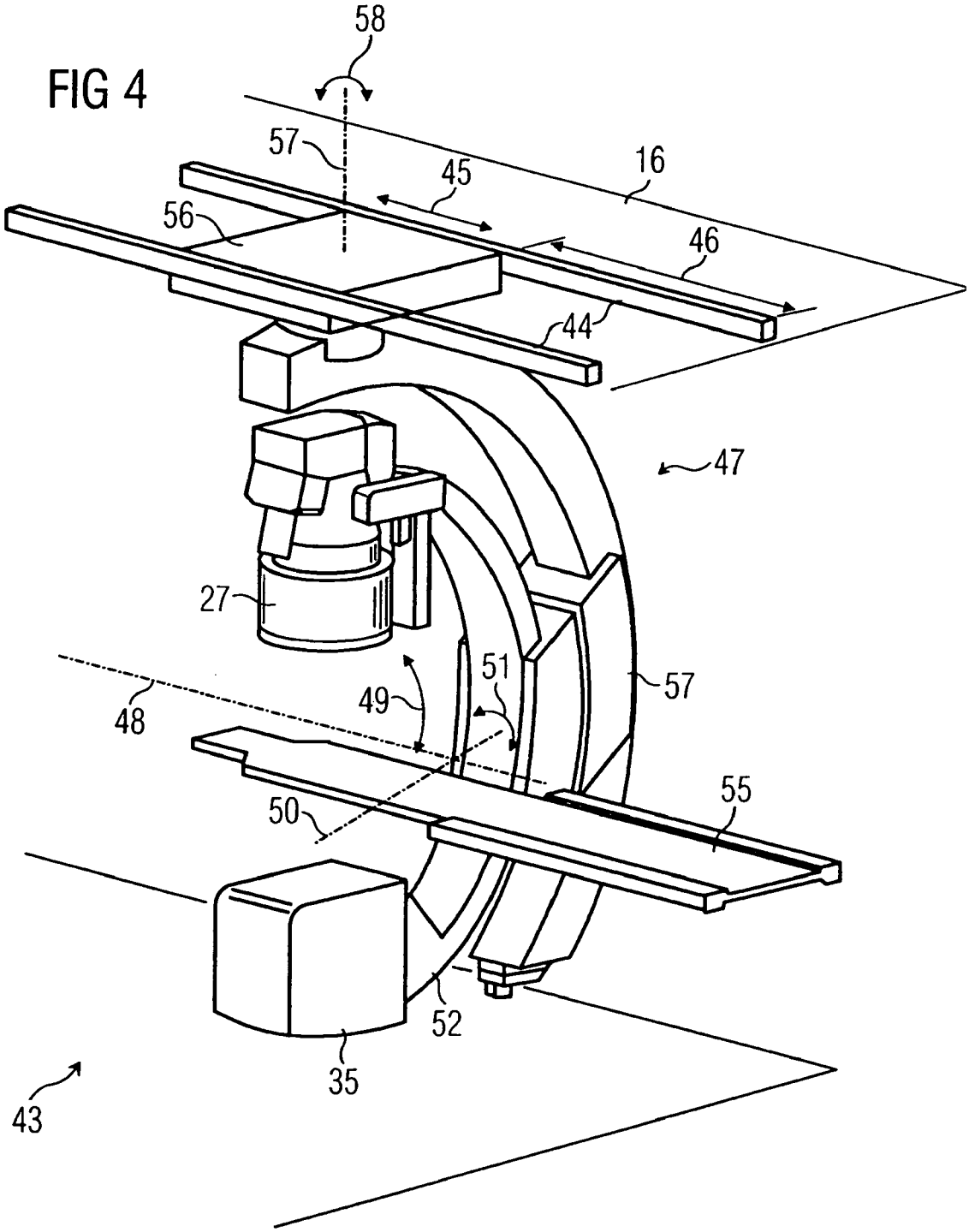
FIG. 4 illustrates one embodiment of an X-ray examination system.

FIG. 4 shows one embodiment of the X-ray examination system. The X-ray examination system 43 includes a C-arm tripod 47, which is displaceable horizontally to various displacement widths 46 in one direction 45 in space on a ceiling 16 of a room by a pair of rails 44. The C-arm tripod 47 has a C-arm mounting arm 52, which is rotatable about a second axis 48 by different orbital angles 49 and about a third axis 50 by different angulation angles 51, for mounting the X-ray emitter 27 and the X-ray receiver 35, and with an examination table 55.

A base 56 connects the ceiling-mounted pair of rails 44 and the C-arm tripod. The base 56 is displaceable in the pair of rails. The base 56 makes it possible to pivot the C-arm tripod 47 about a vertical axis 57 in space by a pivot angle 58. The C-arm tripod 47 is connected to the C-arm tripod 47 via an orbital stroke 57 which enables the rotation of the C-arm mounting arm possible about the second axis 48 in space and the third axis 50 in space.

The orbital angle 49 and/or the angulation angle 51 is determined as the measured variables that definitively determine the resonant frequency, for example, by suitable sensors integrated with the orbital stroke 57. In one embodiment, the ensuing ascertainment of the set-point guided movement and the control of the motion of the C-arm mounting arm 52, the C-arm mounting arm 52 in the guided movement is rotated about the second axis 48 in space and/or the third axis 50 in space, as in a rotational angiography procedure to be described below. In another embodiment, the C-arm mounting arm 52 in the guided movement is displaced in the horizontal direction 45 in space along a longitudinal axis of the examination table 55, analogous to the angiography procedure described in use for FIG. 3, with incremental displacement. In another embodiment, the guided movement of the C-arm mounting arm 52 corresponds to a combination of the two aforementioned forms of motion, as is expedient in automatic positioning, described above with respect to FIG. 2, of the X-ray emitter to an intended mounting position.

During a rotational angiography procedure, the X-ray emitter 27 and the X-ray receiver 35 are in a circular motion state at a constant angular speed. Either the orbital angle 49 or the angulation angle 51 is varied, and the respective other angle, which is accordingly constant, can be taken into account. The other angle can be taken into account in the determination of the resonant frequency or the ascertainment of the set-point guided movement. The application of the control method to this X-ray examination makes vibration-free rotary motion, at a high rotary speed, possible, which is especially advantageous with regard to creating a sharp, interference-free, three-dimensional X-ray image. In rotational angiography, as in angiography with the incremental displacement, a first pass without and a second pass with contrast agent are performed, and by digital subtraction angiography, a differential image with a reproduction of only the vessels is created. The vibration of the X-ray emitter and/or X-ray receiver would cause the respective actual guided movements in the two passes to differ from one another so that in finding the difference, image interference would be created.

In one embodiment, the X-ray examination system 15, 31 or 43 may take into account a variable outfitting, which changes the weight distribution of the various moving system components, in ascertaining the set-point guided movement.

In one embodiment, an X-ray examination system 15, 31, or 43 includes an X-ray emitter and/or X-ray receiver. The X-ray examination system 15, 31, or 43 is movable with regard to its mounting position by a drive device, to make it possible in a simple way to perform an X-ray examination quickly and produce a sharp X-ray image despite a system construction that can be excited to vibration at a resonant frequency, which is dependent on the respective mounting position. At least one variable, which is dependent on the respective mounting position and relevant to the resonant frequency, is detected. A set-point guided movement is ascertained as a function of the at least one respective variable. The set-point guided movement counteracts an excitation of the vibration, for reaching an intended motion state for the X-ray examination of the X-ray emitter and/or X-ray receiver. The guided movement of the X-ray emitter and/or X-ray receiver is controlled by the drive device in accordance with the set-point guided movement.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A method for controlling the guided movement of an X-ray emitter and/or X-ray receiver of an X-ray examination system, the system being movable with a drive device with regard to a mounting position and being excitable to a vibration at a resonant frequency dependent on the mounting position, the method comprising:

detecting at least one variable that is dependent on the mounting position and is relevant to the resonant frequency;

ascertaining a set-point guided movement for attaining a motion state, intended for an X-ray examination in the mounting position, of the X-ray emitter and/or X-ray receiver as a function of the at least one variable, such that the vibration of the X-ray emitter and/or X-ray receiver at the resonant frequency in the intended motion state is avoided;

controlling the guided movement of the X-ray emitter and/or X-ray receiver by the drive device in accordance with the set-point guided movement.

2. The method as defined by claim 1, wherein the at least one variable is detectable by a measurement.

3. The method as defined by claim 1, wherein the at least one variable is detectable from a motion control of the X-ray emitter and/or X-ray receiver.

4. The method as defined by claim 3, wherein the at least one variable comprises at least one actuating variable.

5. The method as defined by claim 1, wherein the X-ray examination system includes a vertically oriented telescoping tripod, which is displaceable in a horizontal plane, the tripod having a telescoping end that can be vertically extended to various extended lengths as a mounting position for the X-ray emitter and/or X-ray receiver, and wherein ascertaining the set-point guided movement of a horizontal displacement position of the telescoping tripod is based on the extension lengths as the at least one variable.

6. The method as defined by claim 5, wherein the X-ray emitter and/or X-ray receiver, on the telescoping end, is tiltable in an orientation to various tilt angles, and wherein ascertaining the set-point guided movement is based on the tilt angle as a further variable.

7. The method as defined by claim 5, wherein the-X-ray examination includes a planigraphy procedure, a rectilinear motion state having a constant speed.

8. The method as defined by claim 1, wherein the X-ray examination system includes an above-table or below-table fluoroscope system with an examination table that is tiltable at different tilt angles, and having one mounting position below and above the examination table, each mounting position being longitudinally displaceable, for the X-ray emitter and the X-ray receiver, and wherein ascertaining the set-point guided movement of the mounting positions is based on the tilt angle as the at least one variable.

9. The method as defined by claim 8, wherein the mounting position, located above the examination table, is displaceable in height at various spacings from the examination table, and wherein ascertaining the set-point guided movement is based on the spacing from the examination table.

10. The method as defined by claim 8, wherein the X-ray examination includes: an angiography procedure including an incremental displacement of the X-ray emitter and/or X-ray receiver to various intended mounting positions, and a motion state with an respective, temporary persistence in one of the mounting positions.

11. The method as defined by claim 1, wherein the X-ray examination system includes a C-arm tripod for mounting the X-ray emitter and the X-ray receiver, the tripod having a C-arm mounting arm operable to rotate by various orbital angles and/or angulation angles, and wherein ascertaining the set-point guided movement of the C-arm mounting arm is based on the orbital angle and/or angulation angle as variables.

12. The method as defined by claim 11, wherein the C-arm tripod is displaceable horizontally by various displacement widths, and the set-point guided movement is ascertained with respect to a horizontal displacement of the C-arm tripod.

13. The method as defined by claim 11, wherein the X-ray examination includes a rotational angiography procedure, a circular motion state having a constant rotary speed.

14. The method as defined by claim 1, comprising positioning, preceding the X-ray examination, the X-ray emitter and/or X-ray receiver to a mounting position intended for the X-ray examination, and persisting a motion state, lasting for the duration of the X-ray examination, in the intended mounting position.

15. The method as defined by claim 1, comprising: storing an association of the resonant frequency with the respective at least one variable, based on a series of tests done prior to equipment operation, in memory and retrieving the association to determine the applicable resonant frequency in operation.

16. The method as defined by claim 1, wherein the ascertainment of the set-point guided movement is followed by a closed-loop control circuit operable to control the drive device, and the damping action of the closed-loop control circuit, which shifts the resonant frequency, is taken into account in the ascertainment.

17. The method as defined by claim 1, comprising:

ascertaining a trial guided movement for attaining the intended motion state without avoidance of the vibration, and ascertaining the set-point guided movement as a function of the at least one respective variable from the trial guided movement, using a filter that prevents the vibration.

18. The method as defined by claim 17, comprising ascertaining the set-point guided movement using an input shaping process.

19. The method as defined by claim 1, wherein the set-point guided movement is ascertained using a jolt-limitation method.

* * * * *